US006738032B1

(12) United States Patent
Park

(10) Patent No.: US 6,738,032 B1
(45) Date of Patent: May 18, 2004

(54) PLASMA DISPLAY PANEL HAVING PADS OF DIFFERENT LENGTH

(75) Inventor: Hun Gun Park, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 164 days.

(21) Appl. No.: 09/717,337

(22) Filed: Nov. 22, 2000

(30) Foreign Application Priority Data

Nov. 24, 1999 (KR) ..... P1999-52533
Nov. 17, 2000 (KR) ..... P2000-68390

(51) Int. Cl.[7] ..... G09G 3/28; H01J 17/49
(52) U.S. Cl. ..... 345/60; 313/583; 315/169.4
(58) Field of Search ..... 345/60–72, 204–212; 349/149–152; 313/583–585; 315/169.1, 169.4

(56) References Cited

U.S. PATENT DOCUMENTS 3,916,393 A * 10/1975 Criscimagna et al. ..... 313/518
3,964,050 A * 6/1976 Mayer ..... 345/61
4,598,960 A * 7/1986 DiSanto et al. ..... 439/66
5,757,450 A * 5/1998 Fujii et al. ..... 349/106
6,100,957 A * 8/2000 Kawada et al. ..... 349/149
6,236,166 B1 * 5/2001 Chou et al. ..... 315/169.1
6,262,541 B1 * 7/2001 Asai ..... 315/169.4
6,411,035 B1 * 6/2002 Marcotte ..... 313/585

FOREIGN PATENT DOCUMENTS

JP 1-166564 6/1989
JP 6-67191 3/1994
JP 11-183884 7/1999

* cited by examiner

*Primary Examiner*—Amr Awad
(74) *Attorney, Agent, or Firm*—Fleshner & Kim, LLP

(57) ABSTRACT

A plasma display panel that is capable of minimizing a brightness difference. In the plasma display panel, a driving waveform supply applies a driving waveform to electrodes provided at an effective display part. Pads apply the driving waveform from the driving waveform supply to the electrodes and have a different length depending on their location. Connecting parts are provided between the pads and the electrodes to electrically connect the pads to the electrodes.

20 Claims, 9 Drawing Sheets

46

30

46

46

46

PLASMA DISPLAY PANEL HAVING PADS OF DIFFERENT LENGTH

BACKGROUND OF THE INVENTION

1. Field of the Invention

This invention relates to a plasma display panel, and more particularly to a plasma display panel that is capable of minimizing a brightness difference.

2. Description of the Related Art

Recently, a plasma display panel (PDP) feasible to a manufacturing of a large-dimension panel has been highlighted as a flat panel display device. The POP typically includes a three-electrode, alternating current (AC) surface discharge PDP that has three electrodes and is driven with an AC voltage as shown in FIG. 1.

Referring to FIG. 1, a discharge cell of the three-electrode, AC surface discharge PDP includes a scanning/sustaining electrode 12Y and a common sustaining electrode 12Z formed on an upper substrate 10, and an address electrode 20X formed on a lower substrate 18. On the upper substrate 10 in which the scanning/sustaining electrode 12Y is formed in parallel to the common sustaining electrode 12Z, an upper dielectric layer 14 and a protective film 16 are disposed. Wall charges generated upon plasma discharge are accumulated in the upper dielectric layer 14. The protective film 16 prevents a damage of the upper dielectric layer 14 caused by the sputtering generated during the plasma discharge and improves the emission efficiency of secondary electrons. This protective film 16 is usually made from MgO. A lower dielectric layer 22 and barrier ribs 24 are formed on the lower substrate 18 provided with the address electrode 20X, and a fluorescent material 26 is coated on the surfaces of the lower dielectric layer 22 and the barrier ribs 24. The address electrode 20X is formed in a direction crossing the scanning/sustaining electrode 12Y and the common sustaining electrode 12Z. The barrier ribs 24 is formed in parallel to the address electrode 20X to prevent an ultraviolet ray and a visible light generated by the discharge from being leaked to the adjacent discharge cells. The fluorescent material 26 is excited by an ultraviolet ray generated upon plasma discharge to produce a red, green or blue color visible light ray. An active gas for a gas discharge is injected into a discharge space defined between the upper/lower substrate and the barrier rib.

As shown in FIG. 2, such a discharge cell is arranged in a matrix type. In FIG. 2, the discharge cell 1 is provided at each intersection among scanning/sustaining electrode lines Y1 to Ym, common sustaining electrode lines Z1 to Zm and address electrode lines X1 to Xn. The scanning/sustaining electrode lines Y1 to Ym are sequentially driven while the common sustaining electrode lines Z1 to Zm are commonly driven. The address electrode lines X1 to Xn are driven with being divided into odd-numbered lines and even-numbered lines.

Such a three-electrode, AC surface discharge PDP is driven with being separated into a number of sub-fields. In each sub-field interval, a light emission having a frequency proportional to a weighting value of a video data is conducted to provide a gray scale display. For instance, if a 8-bit video data is used to display a picture of 256 gray scales, then one frame display interval (e.g., 1/60 second=16.7 msec) in each discharge cell 1 is divided into 8 sub-fields SF1 to SF8. Each sub-field is again divided into a reset interval, an address interval and a sustaining interval. A weighting value at a ratio of 1:2:4:8: . . . :128 is given in the sustaining interval. Herein, the reset interval is a period for initializing the discharge cell; the address interval is a period for generating a selective address discharge in accordance with a logical value of a video data; and the sustaining interval is a period for sustaining the discharge in a discharge cell in which the address discharge has been generated. The reset interval and the address interval are equally assigned in each sub-field interval.

The scanning/sustaining electrode lines Y and the common sustaining electrode lines Z of the plasma display panel receive a driving waveform via a pad portion 30 shown in FIG. 3. Referring to FIG. 3, the pad portion 30 includes pads 31 for receiving a driving waveform from a driving waveform supply, and connecting parts 32 for applying the driving waveform inputted to the pads 31 to the scanning/sustaining electrode lines Y or the common sustaining electrode lines Z. Each pad 31 is connected to a connector 34 of the driving waveform supply as shown in FIG. 4. The driving waveform supply applies the driving waveform inputted to the scanning/sustaining electrode lines Y or the common sustaining electrode lines Z to the connectors 34. The driving waveform inputted to the connectors 34 is applied, via the pads 31 and the connecting parts 32, to the scanning/sustaining electrode lines Y or the common sustaining electrode lines Z. In this case, a longitudinal width of each connector 34 is formed to be narrower than a width of an effective display part in which a picture is to be displayed in compliance with a trend toward a slim-type PDP. Thus, a width of the pad 31 set in correspondence with a longitudinal width of the connector 34 also is formed narrowly. Accordingly, a length of a connecting part 32 provided between the pads 31 and the electrodes Y and Z formed at the periphery of the effective display part becomes longer than that of a connecting part 32 provided between the pads 31 and the electrodes Y and Z formed at the center portion of the effective display part. More specifically, a length sum L1+L2 of a pad 31 and a connecting part 32 for supplying a driving waveform to the electrodes Y and Z formed at the center portion of the effective display part is different from a length sum L3+L4 of a pad 31 and a connecting part 32 for supplying a driving waveform to the electrodes Y and Z formed at the periphery of the effective display part. If the lengths of the pads 31 and the connecting parts 32 provided at the pad portion 30 are different depending on their position, then a voltage applied from the pad portion 30 to the electrodes Y and Z becomes different. In other words, the electrodes Y and Z receiving a driving waveform via L3 and L4 is supplied with a smaller voltage than the electrodes Y and Z receiving a driving waveform via L1 and L2 due to a voltage drop. More specifically, the electrodes Y and Z formed at the periphery of the effective display part generates a voltage drop because they receive a driving waveform via the long connecting part L3. Thus, a brightness difference is generated between the periphery and the center of the effective display part. Also, since the conventional pad portion 30 has a large angle at a portion in which the electrodes Y and Z formed at the periphery of the effective display part are connected to the connecting part 32, a breakage may be generated in the course of a electrode fabricating process of the pad portion 30. Furthermore, the conventional pad portion 30 has a problem in that, since the conventional pad portion 30 also has a large angle at a portion in which the connecting part 32 and the pad 31 formed at the periphery of the pad portion 30 are connected to each other also, a breakage is generated in the course of its electrode fabricating to cause a product badness or deteriorate the productivity.

Meanwhile, the pad portion may be arranged in correspondence with the periphery of the effective display part as shown in FIG. 5 in consideration of a location of the connector or the circuit arrangement, etc. Referring to FIG. 5, a pad portion 38 is arranged to correspond to a first periphery 40 of the effective display part. Each pad 36 is connected to each connector 44. A driving waveform inputted from the connector 44 is applied, via a connecting part 34, to the electrodes Y and Z provided within the effective display part. If the pad portion 38 is formed at the first periphery 40 of the effective display part, then a length sum L7+L8 of the pad 36 and the connecting part 34 for applying a driving waveform to the electrodes Y and Z formed at the first periphery 40 becomes different from a length sum LS+L6 of the pad 36 and the connecting part 34 for applying a driving waveform to the electrodes Y and Z formed at a second periphery 42. Thus, a voltage supplied from the pad portion 38 to the electrodes Y and Z formed at the first periphery 40 becomes a voltage supplied from the pad portion 38 to the electrodes Y and Z formed at the second periphery 42. In other words, the electrodes Y and Z receiving a driving waveform via L5 and L6 is supplied with a smaller voltage than the electrodes Y and Z receiving a driving waveform via L7 and L8 due to a voltage drop. Accordingly, a brightness difference is generated between the first periphery 40 and the second periphery 42 of the effective display part. Furthermore, the conventional pad portion 38 has a problem in that, since the connecting part 32 connected from the second periphery 42 to the pad 38 has a large angle, a breakage is generated in the course of a manufacturing and installation process of the pad portion 38 to cause a product badness or deteriorate the productivity. The above-mentioned problems also may be generated at a pad portion (not shown) for applying a driving waveform to the address electrode lines X.

SUMMARY OF THE INVENTION

Accordingly, it is an object of the present invention to provide a plasma display panel (PDP) that is capable of minimizing a difference, that is, a voltage drop applied to an effective display part to diminution the brightness difference.

A Further object of the present invention is to provide a PDP wherein an angle between an effective display part and a connecting part and an angle between a connecting part and a pad are slowly formed so as to minimize a breakage that may be generated in the course of a electrode fabricating process of a pad portion.

In order to achieve these and other objects of the invention, a plasma display panel according to an embodiment of the present invention includes driving waveform supplying means for applying a driving waveform to electrodes provided at the effective display part; a plurality of pads for applying the driving waveform inputted from the driving waveform supplying means to the electrodes, said pads having a different length depending on their location; and connecting means provided between the pads and the electrodes to electrically connect the pads to the electrodes.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
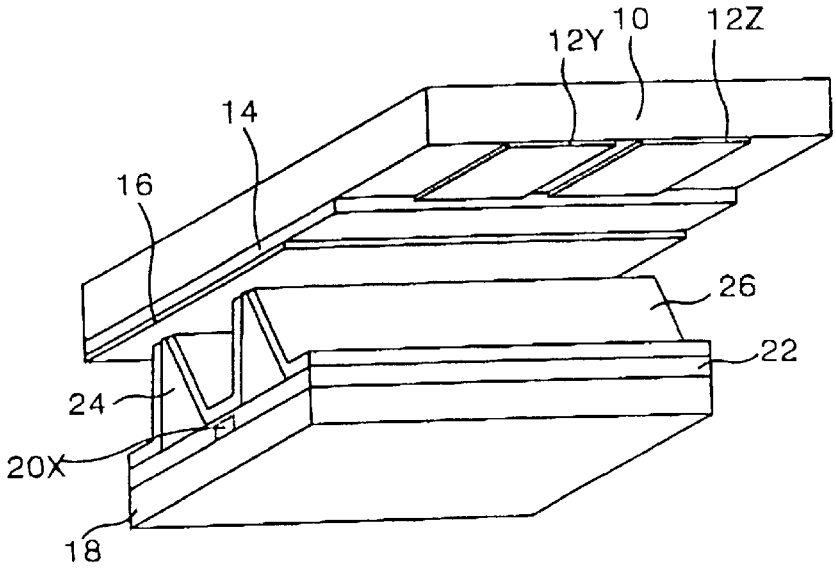
FIG. 1 CONVENTIONAL ART
FIG. 1 is a perspective view showing a structure of a discharge cell of a conventional three-electrode, AC surface discharge plasma display panel.
Figure 2:
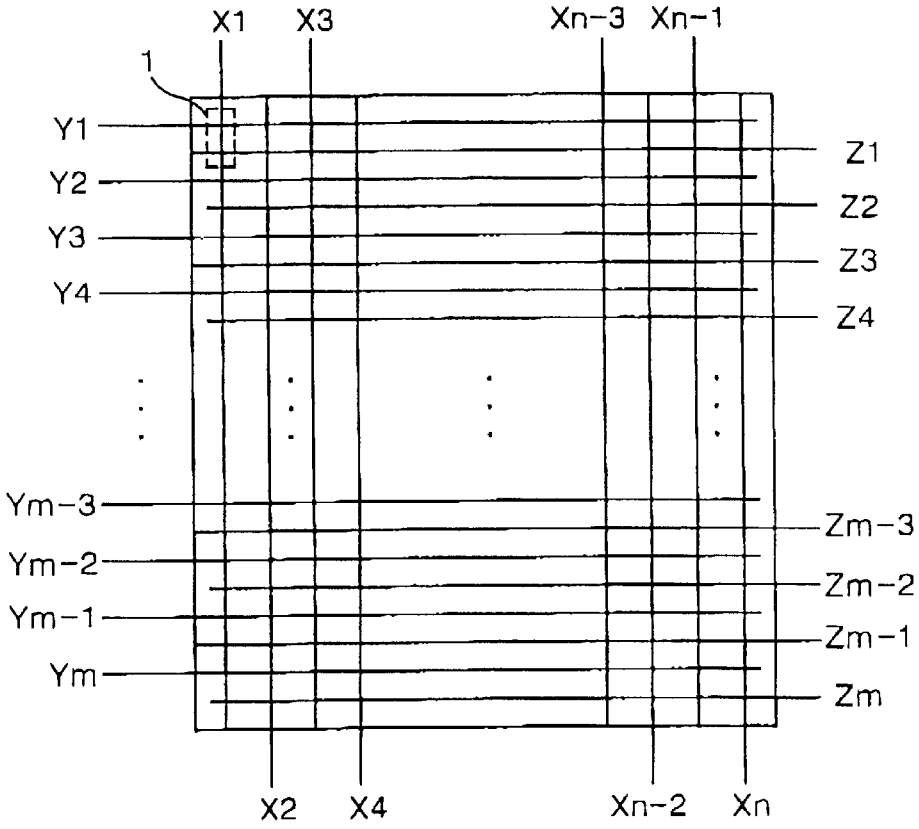
FIG.2 CONVENTIONAL ART
FIG. 2 illustrates an entire electrode arrangement of a plasma display panel including the discharge cells shown in FIG. 1.
Figure 3:
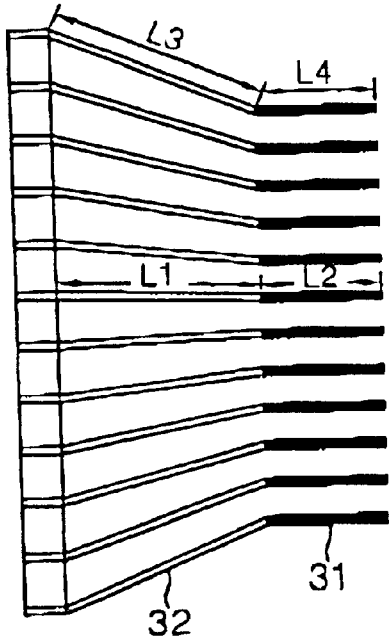
FIG.3 CONVENTIONAL ART
FIG. 3 is a schematic view showing a pad portion installed in correspondence with the center portion of the plasma display panel to apply a driving waveform to the electrodes in FIG. 2.
Figure 4:
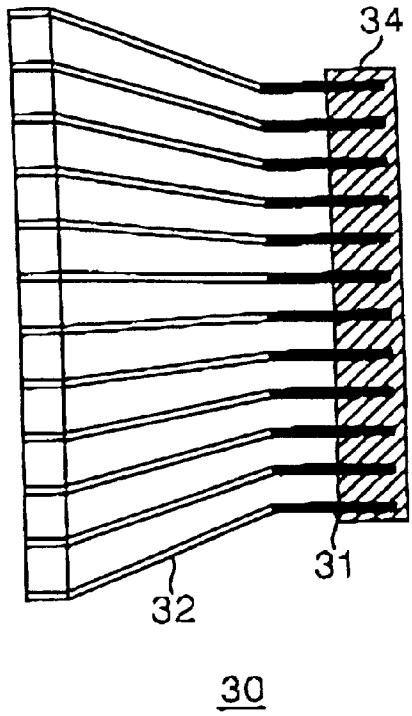
FIG. 4 CONVENTIONAL ART
FIG. 4 is a schematic view showing the pad portion of FIG. 3 that is in contact with connectors for supplying a driving waveform.
Figure 5:
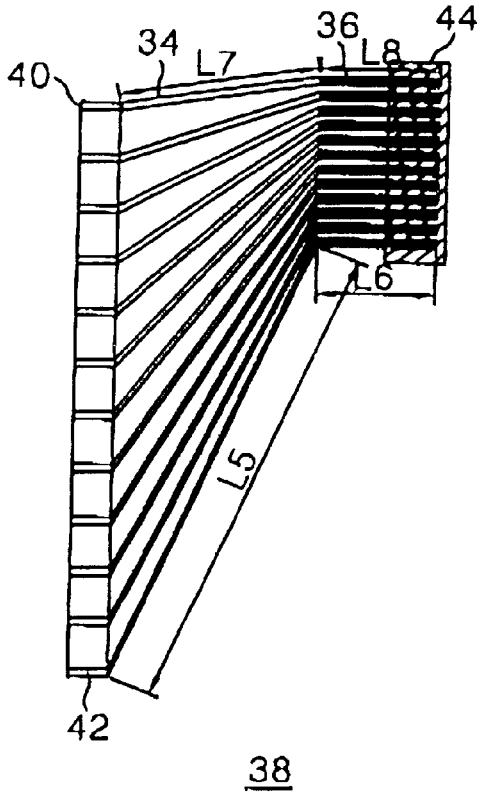
FIG. 5 CONVENTIONAL ART
FIG. 5 is a schematic view showing a pad portion installed in correspondence with one side periphery of the plasma display panel to apply a driving waveform to the electrodes in FIG. 2.
Figure 6:
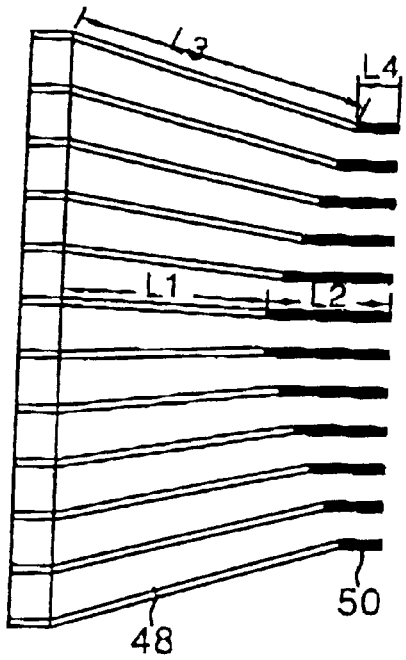
FIG. 6 and FIG. 7 are schematic views showing a pad portion according to an embodiment of the present invention.
Figure 7:
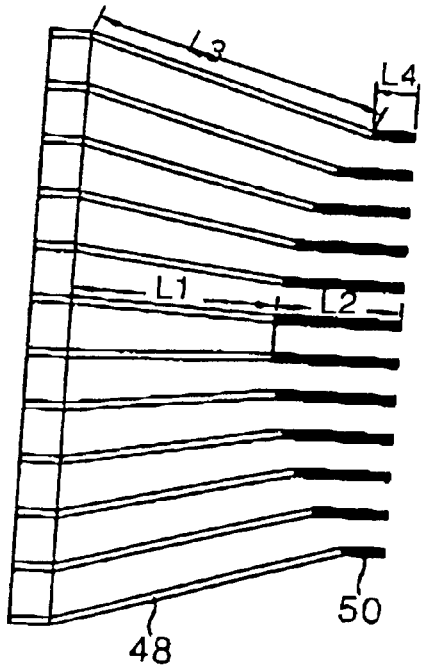
Figure 8:
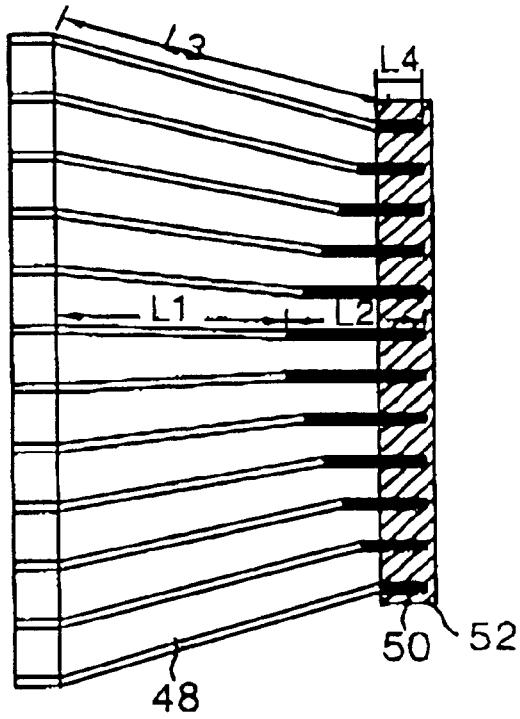
FIG. 8 is a schematic view showing the pad portion of FIG. 6 that is in contact with connectors for supplying a driving waveform.

IS Referring to FIG. 6 and FIG. 7, there is shown a pad portion 46 according to an embodiment of the present invention. The pad portion 46 includes pads 50 having a different length, and connecting parts 48 provided between an effective display part in which a picture is to be displayed and each pad 50. As shown in FIG. 8, each pad 50 is connected to a connector 52 so as to receives a driving waveform from a driving waveform supply (not shown). The driving waveform supply applies the driving waveform inputted to scanning/sustaining electrode lines Y or common sustaining electrode lines Z to the connectors 52. The driving waveform inputted to the connectors 52 is applied, via the pads 50 and the connecting parts 48, to the scanning/sustaining electrode lines Y or the common sustaining electrode lines Z. The pad 50 has a large length at the center portion thereof while having a smaller length as it goes from the center portion thereof into the periphery thereof so that it can minimize a voltage drop in a driving waveform applied from the connector 52 to the electrodes Y and Z. To the contrary, the connecting part 48 has a small length at the center portion thereof while having a larger length as it goes from the center portion thereof into the periphery thereof. Accordingly, a difference between a length sum L1+L2 of the pad 50 and the connecting part 48 for applying a driving waveform to the electrodes Y and Z formed at the center portion of the effective display part and a length sum L3+L4 of the of the pad 50 and the connecting part 48 for applying a driving waveform to the electrodes Y and Z formed at the periphery of the effective display part is minimized. In other words, a brightness difference between the periphery and the center of the PDP can be minimized. Also, the pad 50 formed at the periphery of the pad portion 46 has a small length and, therefore, a portion in which the connecting part 48 and the electrodes Y and Z formed at the periphery of the effective display part are connected to each other and a portion in which the pad 50 and the connecting part 48 formed at the periphery of the pad portion 46 are connected to each other have a small angle, so that it becomes possible to minimize a breakage that may be generated in the course of a electrode fabricating process of the pad portion 46.

Figure 9:
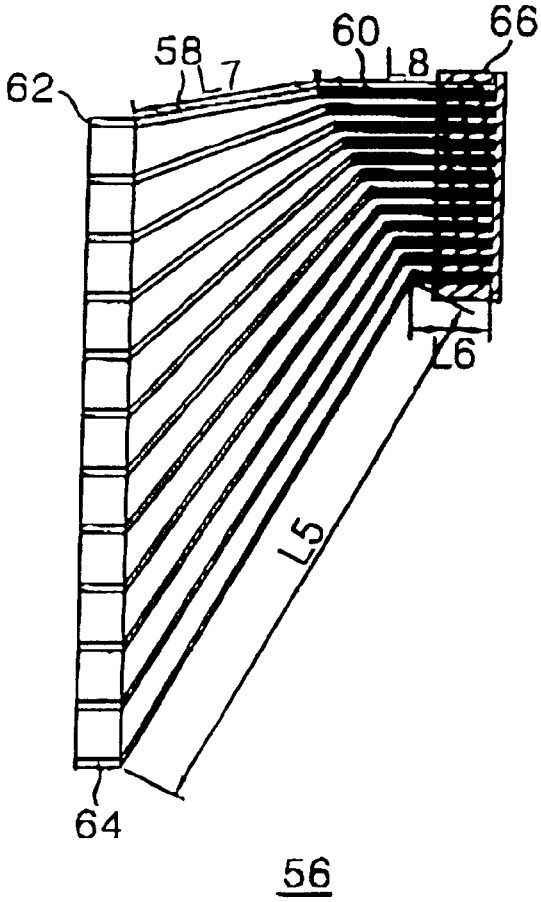
FIG. 9 is a schematic view showing a pad portion according to another embodiment of the present invention.

FIG. 9 is a schematic view of a pad portion of a plasma display panel according to another embodiment of the present invention, which shows a structure of a pad portion 56 when the pad portion 56 has been installed at a first periphery 62 of an effective display part. Referring to FIG. 9, pads 60 have a different length so as to minimize a voltage drop of a driving waveform applied form connectors 66 to electrodes Y and Z. More specifically, the pad 60 applying a driving waveform to the electrodes Y and Z provided at a first periphery 62 has a large length while having a smaller length as it goes from the first periphery 62 into the second periphery 64. To the contrary, connecting parts 56 have a larger length as they go from the first periphery 62 into the second periphery 64. Accordingly, a difference between a length sum L7+L8 of the pad 60 and the connecting part 58 for applying a driving waveform to the electrodes Y and Z formed at the first periphery 62 of the effective display part and a length sum LS+L6 of the of the pad 60 and the connecting part 58 for applying a driving waveform to the electrodes Y and Z formed at the second periphery 64 of the effective display part is minimized. In other words, a brightness difference between the first periphery 62 and the second periphery of the PDP can be minimized. Also, the pad 60 for applying a driving waveform to the second periphery 64 has a small length and, therefore, a portion in which the pad 60 and the connecting part 58 are connected to each other and a portion in which the connecting part 58 and the electrodes Y and Z formed at the second periphery 64 of the effective display part are connected to each other have a small angle, so that it becomes possible to minimize a breakage that may be generated in the course of a electrode fabricating process of the pad portion 46.

The above-mentioned embodiments of the present invention are applicable to a pad portion for applying a driving waveform to address electrode lines X.

As described above, according to the present invention, the pads have a different length so as to minimize a voltage drop of a driving waveform applied from the pad portion to the electrodes. Accordingly, a brightness difference at the effective display part caused by a voltage drop in a driving waveform applied to the electrodes can be minimized. Furthermore, since the pads have a different length, an angle at each portion in which the pad and the electrodes at the effective display part are connected to each other can be minimized. Accordingly, it becomes possible to prevent a breakage that may be generated in the course of a electrode fabricating process of the pad portion.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel including an effective display part in which a picture is to be displayed, said plasma display panel comprising:

driving waveform supplying means for applying a driving waveform to electrodes provided at the effective display part;

a plurality of pads for applying the driving waveform inputted from the driving waveform supplying means to the electrodes, said pads having a different length depending on their location; and connecting means provided between the pads and the electrodes to electrically connect the pads to the electrodes, wherein an angle formed by the connection means between a respective pad and the connection means is different for adjacent pads, and wherein the pads have a smaller length as they go from the center thereof into the periphery thereof.

2. The plasma display panel as claimed in claim 1, wherein the connecting means have a smaller length as they go from the periphery thereof into the center thereof.

3. The plasma display panel as claimed in claim 1, wherein the pads are connected to connectors of the driving waveform supplying means to apply a driving waveform to the electrodes.

4. The plasma display panel as claimed in claim 1, wherein the pads have a smaller length as they go from a center with respect to the effective display area to a periphery.

5. A plasma display panel including an effective display part in which a picture is to be displayed, said plasma display panel comprising:

driving waveform supplying means for applying a driving waveform to electrodes provided at the effective display part;

a plurality of pads for applying the driving waveform inputted from the driving waveform supplying means to the electrodes, said pads having a different length depending on their location; and connecting means provided between the pads and the electrodes to electrically connect the pads to the electrodes, wherein an angle formed by the connection means between a respective pad and the connection means is different for adjacent pads and, wherein the pads have a smaller length as they go from one side periphery thereof into other side periphery thereof.

6. The plasma display panel as claimed in claim 5, wherein the connecting means have a larger length as they go from one side periphery thereof into the other side periphery thereof.

7. The plasma display panel as claimed in claim 5, wherein the pads are connected to connectors of the driving waveform supplying means to apply a driving waveform to the electrodes.

8. A plasma display panel, comprising:

a plurality of electrodes provided in an effective display area;

a driving waveform supplying device configured to apply a driving waveform to the plurality of electrodes;

a plurality of pads configured to apply the driving waveform inputted from the driving waveform supplying device to the plurality of electrodes, said pads having a different length based on their location; and a plurality of connectors extending between the pads and the electrodes and configured to electrically connect the pads to the electrodes, wherein the connectors are not parallel to one another, and wherein the pads have a smaller length as they go from a center with respect to the effective display area to a periphery.

9. The plasma display panel as claimed in claim 8, wherein the connectors have a smaller length as they go from a periphery with respect to the effective display area to a center.

10. The plasma display panel as claimed in claim 8, wherein the pads are connected to connectors of the driving waveform supplying device to apply a driving waveform to the electrodes.

11. A plasma display panel, comprising:

a plurality of electrodes provided in an effective display area;

a driving waveform supplying device configured to apply a driving waveform to the plurality of electrodes;

a plurality of pads configured to apply the driving waveform inputted from the driving waveform supplying device to the plurality of electrodes, said pads having a different length based on their location; and a plurality of connectors extending between the pads and the electrodes and configured to electrically connect the pads to the electrodes, wherein the connectors are not parallel to one another, and wherein the pads have a smaller length as they go from one side periphery with respect to the effective display area to the other side periphery.

12. The plasma display panel as claimed in claim 11, wherein the connectors have a larger length as they go from one side periphery with respect to the effective display area to the other side periphery.

13. A plasma display panel, comprising:

a plurality of electrodes provided in an effective display area;

a driving waveform supplying device configured to apply a driving waveform to the plurality of electrodes;

a plurality of pads configured to apply the driving waveform inputted from the driving waveform supplying device to the plurality of electrodes, said pads having a different length based on their location; and a plurality of connectors extending between the pads and the electrodes and configured to electrically connect the pads to the electrodes, wherein the connectors are not parallel to one another, and wherein each pad and connector connected thereto have substantially the same combined length.

14. A plasma display panel, comprising:

a plurality of electrodes provided in an effective display area;

a driving waveform supplying device configured to apply a driving waveform to the plurality of electrodes;

a plurality of pads configured to apply the driving waveform inputted from the driving waveform supplying device to the plurality of electrodes, said pads having a different length based on their location; and a plurality of connectors extending between the pads and the electrodes to electrically connect the pads to the electrodes, wherein all of the connectors have the same width, and wherein the pads have a smaller length as they go from a center with respect to the effective display area to a periphery.

15. The plasma display panel as claimed in claim 14, wherein the connectors have a smaller length as they go from a periphery with respect to the effective display area to a center.

16. The plasma display panel as claimed in claim 14, wherein the pads are connected to connectors of the driving waveform supplying device to apply a driving waveform to the electrodes.

17. A plasma display panel, comprising:

a plurality of electrodes provided in an effective display area;

a driving waveform supplying device configured to apply a driving waveform to the plurality of electrodes;

a plurality of pads configured to apply the driving waveform inputted from the driving waveform supplying device to the plurality of electrodes, said pads having a different length based on their location; and a plurality of connectors extending between the pads and the electrodes to electrically connect the pads to the electrodes, wherein all of the connectors have the same width, and wherein the pads have a smaller length as they go from one side periphery with respect to the effective display area to the other side periphery.

18. The plasma display panel as claimed in claim 17, wherein the connectors have a larger length as they go from one side periphery with respect to the effective display area to the other side periphery.

19. A plasma display panel, comprising:

a plurality of electrodes provided in an effective display area;

a driving waveform supplying device configured to apply a driving waveform to the plurality of electrodes;

a plurality of pads configured to apply the driving waveform inputted from the driving waveform supplying device to the plurality of electrodes, said pads having a different length based on their location; and a plurality of connectors extending between the pads and the electrodes to electrically connect the pads to the electrodes, wherein all of the connectors have the same width, and wherein each pad and connector connected thereto have substantially the same combined length.

20. A plasma display panel, comprising:

a plurality of electrodes provided in an effective display area;

a driving waveform supplying device configured to apply a driving waveform to the plurality of electrodes;

a plurality of pads configured to apply the driving waveform inputted from the driving waveform supplying device to the plurality of electrodes, said pads having a different length based on their location; and a plurality of connectors extending between the pads and the electrodes and configured to electrically connect the pads to the electrodes, wherein each pad and connector connected thereto have substantially the same combined length.

* * * * *